US005133852A

United States Patent [19]

Wark

[11] Patent Number: 5,133,852

[45] Date of Patent: Jul. 28, 1992

[54] COAL SIZING GRID

[76] Inventor: Rickey E. Wark, 2217 Lake Angelus Rd., Pontiac, Mich. 48055

[21] Appl. No.: 560,076

[22] Filed: Jul. 30, 1990

[51] Int. Cl.[5] ..... B07B 1/50

[52] U.S. Cl. ..... 209/389; 209/393; 241/81

[58] Field of Search ..... 241/36, 190, 187, 88.4, 241/243, 236, 81, 82; 209/389, 393, 283, 678

[56] References Cited

U.S. PATENT DOCUMENTS

| | | | |
|---|---|---|---|
| Re. 11,634 | 10/1897 | Williams | 241/88.4 X |
| 1,485,872 | 3/1924 | Nelson | 209/389 X |
| 2,183,583 | 12/1939 | Patterson | 241/88.4 X |
| 3,074,655 | 1/1963 | Gontier | 241/88.4 |
| 3,154,622 | 10/1964 | Reinfeld et al. | 241/88.4 X |
| 4,221,341 | 9/1980 | Schymura et al. | 241/88.4 X |
| 4,592,516 | 6/1986 | Tschantz | 241/187 X |
| 4,709,197 | 11/1987 | Goldhammer et al. | 241/36 X |
| 4,721,257 | 1/1988 | Williams et al. | 241/36 |
| 4,793,561 | 12/1988 | Burda | 241/36 |
| 4,966,689 | 10/1990 | Wark et al. | 241/81 X |

FOREIGN PATENT DOCUMENTS

| | | | |
|---|---|---|---|
| 687860 | 2/1953 | United Kingdom | 209/678 |

*Primary Examiner*—Mark Rosenbaum
*Assistant Examiner*—Frances Chin
*Attorney, Agent, or Firm*—Krass & Young

[57] ABSTRACT

A self-cleaning size-segregating grid for a coal crusher has two parallel clearing combs made up of rigid steel fingers which rotate through the grid bars to clear jammed materials therefrom. The propeller-like fingers are preferably staggered in angular orientation on their respective shafts. The shafts are spaced so that the swept volumes of the fingers overlap. A surge detector senses drive motor current as an indication of stall or incipient stall and automatically reverses the direction of rotation of the clearing combs.

20 Claims, 2 Drawing Sheets

COAL SIZING GRID

INTRODUCTION

This invention relates to sizing apparatus of the type used, for example, to segregate a stream of coal as between relatively large and small particles en route to a crusher. More particularly, the invention provides a selfcleaning segregating grid utilizing one or more continuously rotating clearing combs for removing material from the bars of the grid, thereby to promote an even and efficient flow of material through the segregating grid.

BACKGROUND OF THE INVENTION

The boilers of coal-fired steam generators in electric utility plants are typically used in conjunction with crushers to reduce raw coal to chunks or particles of less than a certain size prior to pulverization and introduction to the boiler combustion chamber. To prolong the life of the crusher components, the coal is first passed through a grid made up of parallel bars disposed in the vertical path of a coal chute and spaced apart to pass smaller chunks such that they may be diverted around, rather than through, the crusher. In a given coal stream, this segregation may result in between 40% and 80% of the coal bypassing the crusher.

The grid in the aforementioned apparatus is typically made up of steel bars welded into a grid and disposed in a vertical chute at an angle such that smaller chunks of material pass through while larger chunks of material are caught by the grid and directed into the crusher. In such an operation, some coal chunks are inevitably of such size as to collect on and between the grid bars. Ultimately, such collected materials jam or plug the grid in varying degrees and degrade the efficiency of the segregating operation. To ensure proper operation, these collected materials must be removed from the grid.

For this purpose it is known to use a clearing comb made up of rigid steel fingers normally located in a home position below and behind the grid where it is essentially out of the path of travel of the material which passes through the grid. The comb is periodically actuated by an air cylinder or the like to cause the fingers to lift as a unit and to simultaneously pass upwardly through and between the grid bars to lift and clear the jammed materials from the grid. The air cylinder is then deactivated and the comb drops back to the home position.

While the comb fingers pass between the grid bars, they effectively block the grid and divert all material into the crusher.

SUMMARY OF THE INVENTION

The subject invention provides an apparatus for rough size-segregation of coal and other particulate material wherein a segregation grid is continuously cleared of material which jams between or bridges the bars of the grid. In general, this is achieved through the use of a rotating comb comprising a plurality of parallel fingers which rotate through and between the bars of the grid about an axis which passes essentially through and at right angles to the grid bars.

In an illustrative embodiment further disclosed herein, a segregation grid is equipped with two rotating combs, the fingers of respective combs rotating about spaced parallel axes and driven by a single motor. The fingers of each comb are progressively staggered in angular position and the two combs are arranged relative one another so that the swept volumes thereof overlap. Comb fingers are angularly arranged to avoid mechanical interference during rotation. In a preferred form, the comb fingers are staggered in angular relationship to one another or arranged in staggered groups so that the grid is never completely blocked over its entire area. In this fashion, the crusher is uniformly loaded at all times. In fact, the comb fingers may be arranged on two or more parallel, spaced axles which are synchronously driven. Moreover, means are provided for reversing the direction of rotation of the combs. In the illustrative embodiment, this is achieved on a demand basis by monitoring comb drive motor current and activating a reversing switch whenever an increase in motor current indicates a stalled or incipient stall condition in the motor.

While the invention is illustrated in connection with a crusher apparatus for coal, it may be used to provide a primary size-segregation operation for any randomly sized particulate material including aggregate. The terms "particulate" and "particle," as used herein, are not intended to denote a size range or to suggest extremely fine material such as sand or powder. Rather, such terms are used in a generic sense to suggest any divided solid material which is presented in a varying and typically random size distribution or spread.

DETAILED DESCRIPTION OF THE SPECIFIC/ILLUSTRATIVE EMBODIMENT

Figures 1, 2:
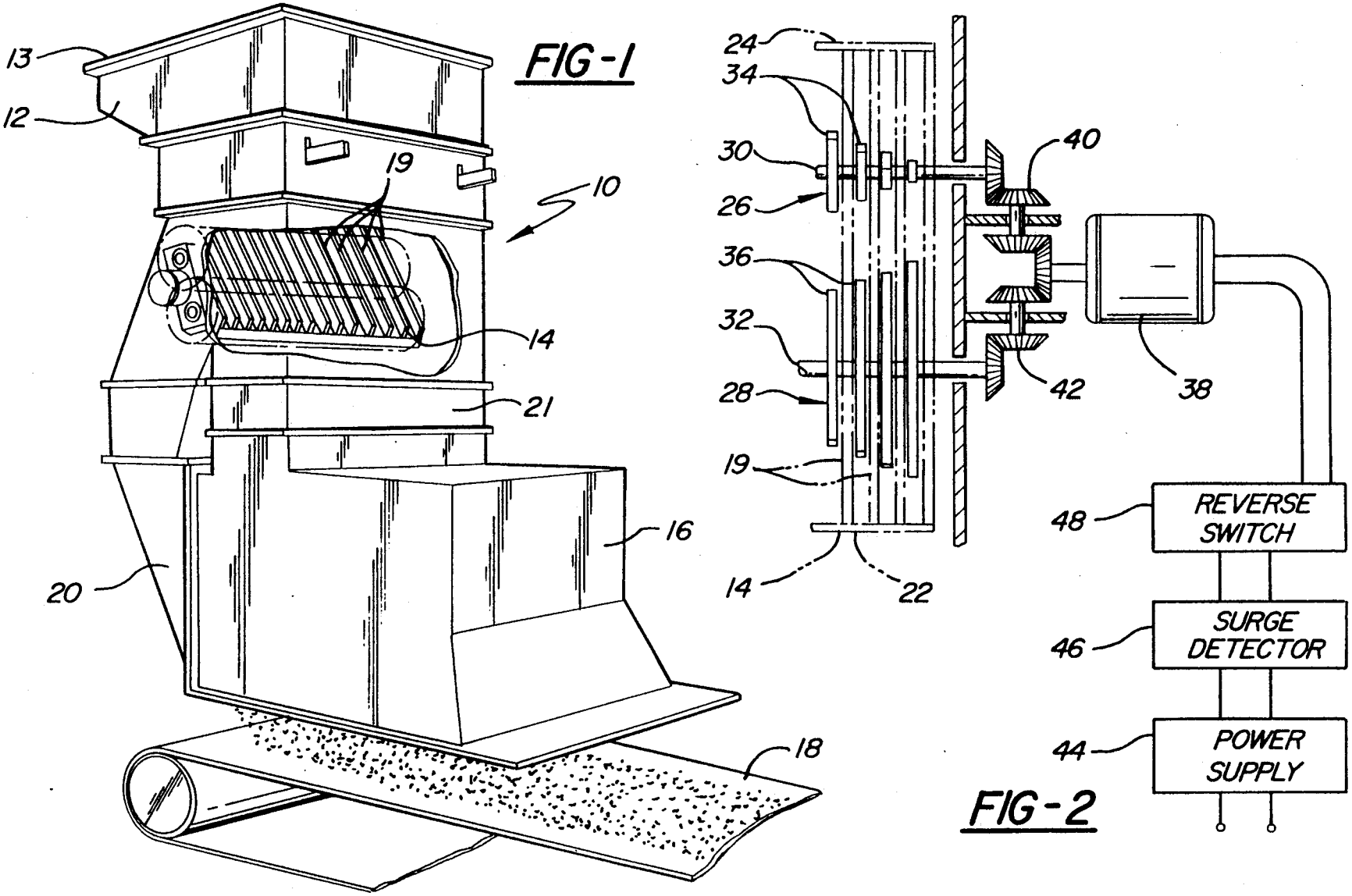
FIG. 1 is a perspective view of a coal crusher with delivery chute and outlet conveyor and with a portion of the chute broken away to indicate the location and environment of a size-segregation grid equipped in accordance with the present invention.
FIG. 2 is a schematic diagram of the double comb drive system with automatic reverse.

Referring to the figures, a coal segregation and crushing apparatus 10 comprises a chute-like input hopper 12 into which divided material such as coal is introduced by way of an appropriate feed system such as a conveyor or trough. In a preferred embodiment, the input hopper 12 is vertically oriented so that the particulate material passes through the hopper 12 along a generally vertical path. The coal falls by gravity through an inlet 13 of input hopper 12 toward a segregation grid 14 which is angularly oriented between the input hopper 12 and a pair of outlet chutes 20 and 21. The segregation grid 14 operates to divert the larger particles or chunks through the outlet chute 21 to a conventional crusher 16. The crushed particles of coal are deposited onto a conveyor 18 which carries the material to a coal pulverizer which further reduces particles to a size suitable for introduction to the combustion chamber of a boiler. Material which is small enough to fall through the spaced parallel bars 19 of the segregation grid 14 go through the outlet chute 20 which bypasses the crusher 16 and directly conveys these finer materials onto the conveyor belt 18. In a given load of coal, some 40% to 80% of the materials may pass through the grid 14 into the outlet chute 20 and the diversion of these material substantially reduces wear on the crusher components, effectively increases crusher throughput and reduces power consumption. In addition, such diversion reduces the accumulation of coal fines in the crusher area.

The segregation grid 14 is made up of parallel essentially blunt tapered bars 19 made of steel and having a rectangular cross section. Bars 19 are welded together in a rigid grid by means of end plates 22 and 24 and the grid is disposed in the input chute of the apparatus 10 at an angle of about 45 degrees from horizontal such that the majority of the material which is too large to pass cleanly through grid bars 19 simply bounces off or slides along the top of the grid bars 19 into the outlet chute 21 which leads into the crusher 16. The spacing between bars 19 determines the size of the material which is deemed appropriate for the pulverizer and, hence, which needs no size reduction by crushing at this point.

Figure 3:
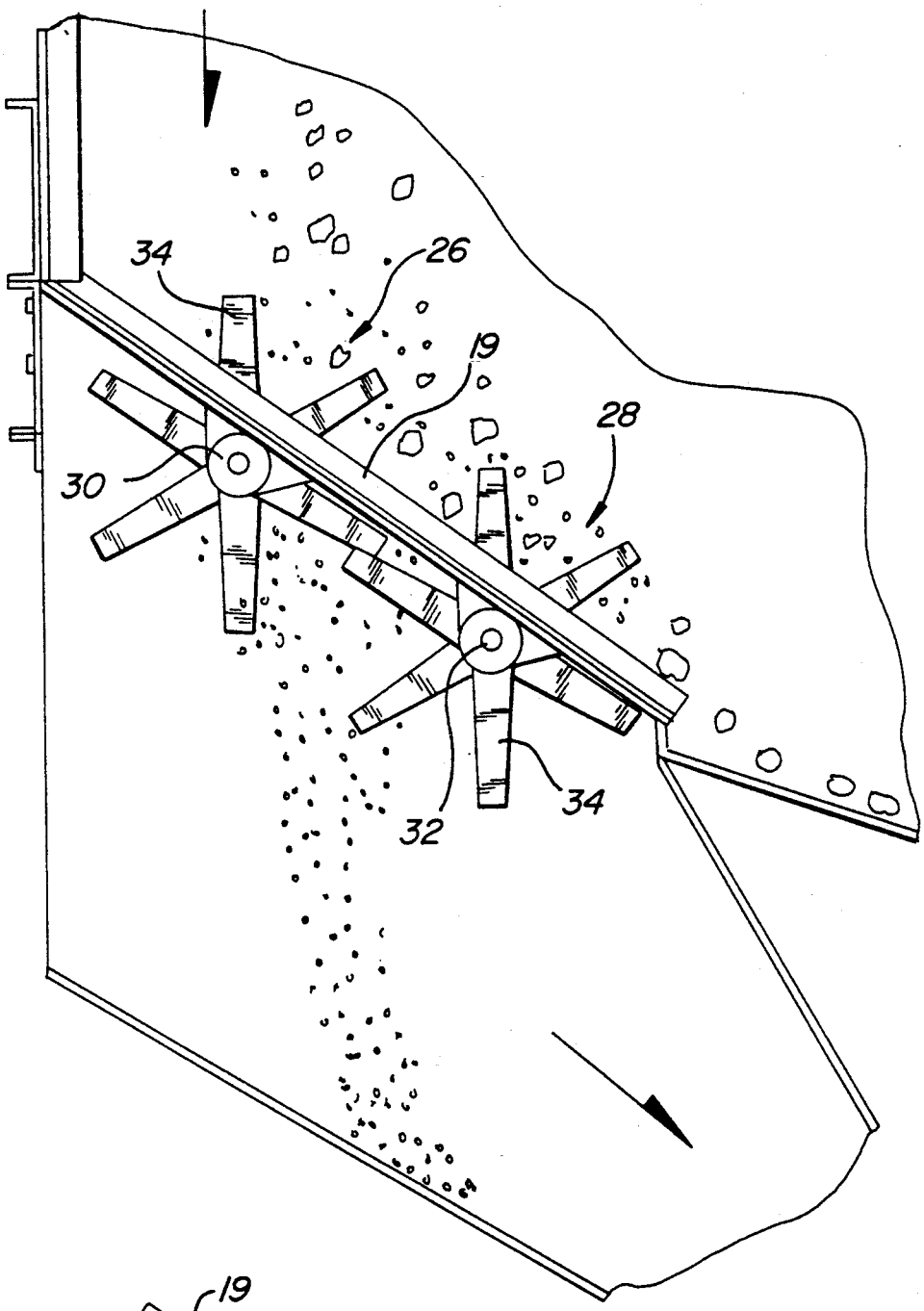
FIG. 3 is a side view of the size-segregation grid of FIG. 1 showing the overlapping relationship of the two clearing combs.

As best shown in FIGS. 2 and 3, the sizing grid 14 is provided with clearing combs 26 and 28 having spaced parallel axes of rotation defined by shafts 30 and 32 passing essentially through and at right angles to the longitudinal axes of the spaced parallel grid bars 19; i.e., for simplicity of construction, the axle shafts 30 and 32 are located just below the plane of the bars 19. Comb 26 comprises a plurality of spaced parallel radial fingers 34 which are disposed along the shaft 30 so as to lie between the parallel bars 19 of the grid 14 such that rotation of shaft 30 causes the fingers 34 to rotate or sweep through a cylindrical volume which covers approximately half of the effective area of the grid 14.

Figure 4:
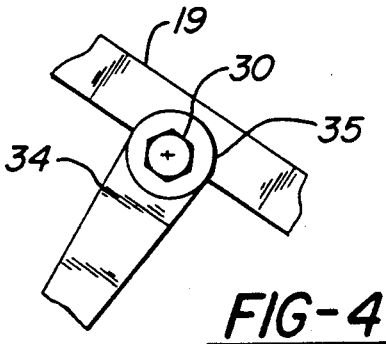
FIG. 4 shows a detail of the installation of a clearing comb finger.

The fingers 34 are made of steel, are preferably straight, tapered toward the ends. The fingers 34, as shown in FIG. 4, extend radially from shaft 30 and are mechanically locked to the shaft 30 to rotate therewith. In the illustration embodiment, the shaft 30 is hexagon shaped and the fingers have hexagon-shaped apertures through which the shaft 30 slides for installation. Spacers (not shown) locate the fingers between the grid bars 19. In addition, the fingers 34 are mounted on the shaft in uniformly and progressively staggered angular positions; i.e., in the case of 6 fingers, the angle between any two adjacent fingers is on the order of 60 degrees. This figure is given for illustration only, as a typical grid has more than six sizing bars. Although not shown, the fingers may also be arranged in groups of, for example, three fingers with the same angular relationship to the shaft 30. The adjacent groups would, in this example, be angularly shifted. This grouping simplifies installation, especially where the number of fingers exceeds the number of facets on shaft 30.

Comb 28 is substantially identical to comb 26, again being made up of rigid steel fingers 36 spaced along the shaft 32 so as to rotate through and between adjacent parallel bars 19 of the grid 14. Fingers 36 are also staggered in angular position and define or sweep through a volume which overlaps the swept volume of comb 26. Accordingly, the fingers 36 are arranged in angular position relative to the fingers 34 so that no mechanical interference occurs during rotation.

As best shown in FIG. 3, the axes of rotation defined by the shafts 30 and 32 are sufficiently close to the plane of the bars 19 that the fingers pass continuously through and between the bars 19 to clear the bars of collected intermediate sized materials. Staggered fingers are more desirable where only a single comb is used, thereby to avoid a condition wherein the entire grid is blocked for a brief instant each time the comb fingers pass through the bars 19. Where multiple combs are used, staggering is less important within an individual comb. But it is still desirable to angularly stagger the combs from one another. As shown in FIG. 4, the fingers 34 have circular steel hubs 35 mounted on shaft 30 for rotation therewith. Hubs 35 extend up between the bars 19 above the axis of rotation to prevent small pieces of coal from jamming the hub as it rotates.

Direction of rotation of combs 26 and 28 may be selected at the operator's discretion. Rotating with the undiverted flow accelerates the particles whereas rotating against the flow throws particles back onto the grid where a greater number may fall through.

Shafts 30 and 32 are continuously rotated by a DC drive motor 38 which is connected to the shafts 30 and 32 through bevel gear systems 40 and 42. The gear systems 40 and 42 are conventional and are sufficiently diagrammatically illustrated in FIG. 2 as to obviate the need for detailed description. Moreover, it is to be understood that the bevel gear drive systems 40 and 42 are merely representative of a variety of drive systems which may be employed; for example, a gear and sprocket drive can be used. The bevel gear systems 40 and 42 are such as to rotate the shafts 30 and 32 in the same angular direction.

DC drive motor 38 is connected to a conventional power supply 44 which is connected to the locally available AC line voltage. Power supply 44 is connected through a motor current surge detector 46 and a reversing switch 48 to the motor 38. The operation of the components 46 and 48 is such that a current amplitude change triggers a surge detector 46 to produce a signal which toggles the reversing switch 48 to reverse the polarity of either field or armature current applied to the motor 38 thereby to reverse the direction of rotation thereof. Surge detector preferably employs both a maximum current amplitude detector and a rate-of-current-amplitude-change detector, such as a differentiator circuit.

OPERATION

Material sized by the grid 14 normally either passes through or is deflected along the top surface of the bars 19. However, as indicated above, intermediate chunks or particles frequently collect on and/or jam between the bars 19 and are cleared therefrom by the fingers 34 and 36 of the combs 26 and 28, respectively. If, however, material collects or jams in sufficient quantity or with severity, the fingers 34 and 36 may stall or jam between the bars 19. In this event, the motor current tends to spike upwardly, a condition which is detected by way of the differentiator circuit in the surge detector 46. The signal from the surge detector 46 is applied to the reversing switch 48, a switch similar to that used in garage door operators for alternating the direction of garage door travel, to reverse the polarity of the power supply to the motor 38 and reverse the direction of motor rotation. This effectively instantaneous reversal in the direction of the output shaft of motor 38 also reverses the direction of rotation of the shafts 30 and 32 and clears the jammed material from the bars.

Although the invention has been described with reference to the system comprising two spaced parallel and overlapping clearing combs, single combs and multiple combs greater than two in number can also be used. While the stall detector and reversing switch 46 and 48, respectively, are preferred, periodic reversals of the comb's direction of rotation may also be activated on a periodic or timed basis. Moreover, the reversing function may be eliminated entirely in favor of continuous, unidirectional rotation, if desired. In another form, hydraulic drive motors may be substituted for the electric drive motors and surge detection may be accomplished by monitoring hydraulic line pressure to the motors. Other variations and modifications in the illustrated system will occur to those skilled in the art.

I claim:

1. In a material segregating apparatus for particulate material such as coal;

an inlet structure disposed to accept particulate material; a first outlet; a second outlet;

a segregating grid interposed between said inlet structure and said first and second outlets comprising a plurality of parallel bars spaced apart to pass material less than a predetermined size between the bars and toward said first outlet and to divert material greater than said predetermined size toward said second outlet;

a first clearing comb comprising a plurality of parallel fingers disposed between the bars; and means for continuously rotating said fingers about an axis passing essentially through and at right angles to said bars such that said fingers pass between and through said bars as they rotate.

2. Apparatus as defined in claim 1 further including means for reversing the direction of rotation of said first clearing comb.

3. Apparatus as defined in claim 2 wherein the reversing means comprises motor means for driving said first clearing comb about said axis of rotation, sensor means for sensing a stalled condition of said motor means, and means connected to said sensor means for reversing the direction of rotation of said motor means when a stalled condition is sensed.

4. Apparatus as defined in claim 3 wherein said motor means is an electric motor and said sensor means includes means for detecting an increase in the amplitude of the current drawn by said motor.

5. Apparatus as defined in claim 1 wherein at least two of said fingers, when at rest, are disposed in different angular positions about said axis of rotation.

6. Apparatus as defined in claim 1 further comprising a second clearing comb made up of a second plurality of parallel fingers disposed for rotation through and between said bars, and means for continuously rotating said second fingers about a second axis of rotation parallel to and spaced from the first axis of rotation and passing essentially through said bars.

7. Apparatus as defined in claim 6 wherein the volume swept by the rotation of the fingers of the first and second clearing combs overlap and the fingers of respective combs between a given pair of adjacent bars are angularly staggered to avoid interference therebetween when rotating.

8. Apparatus as defined in claim 7 wherein the first and second combs rotate in the same direction.

9. Apparatus as defined in claim 8 further including means for reversing the direction of rotation of said first and second combs.

10. Apparatus as defined in claim 9 wherein the reversing means comprises motor means for driving said combs about said axes of rotation, sensor means for sensing a stalled condition of said motor means, and means connected to said sensor means for reversing the direction of rotation of said motor means when a stalled condition is sensed.

11. Apparatus as defined in claim 10 wherein said motor means is an electric motor and said sensor means includes means for detecting an increase in the amplitude of the current drawn by said motor.

12. Apparatus as defined in claim 8 wherein said comb fingers, when at rest, are disposed in angularly staggered positions about said axes of rotation.

13. An apparatus for segregating particulate material by size comprising:

an input chute having a vertical path portion for particulate material;

a first chute connected to receive material from the input chute;

a second chute connected to receive material from the input chute;

a grid angularly oriented in the vertical path of said input chute to intercept particulate material from said input chute and to pass material of less than a predetermined size to the first chute and to divert material of at least said predetermined size to the second chute; and a first clearing comb;

wherein said grid comprises a plurality of uniformly spaced, essentially blunt, parallel bars, wherein said first clearing comb comprises a plurality of fingers interposed between said parallel bars, and at least one axle shaft whose axis passes essentially through said parallel bars, said fingers being attached to said axle shaft for rotation therewith; and means for essentially continuously slowly rotating said clearing comb so as to continuously clear said grid.

14. Apparatus as defined in claim 13 further comprising a second clearing comb associated with said grid and said first clearing comb and made up of a second plurality of fingers interposed between said parallel bars, having at least one axle shaft whose axis passes essentially through said parallel bars, said fingers being attached to said axle shaft for rotation therewith and means for essentially continuously rotating said second clearing comb.

15. Apparatus as defined in claim 14 further including means for reversing the direction of rotation of said first and second clearing combs, wherein said reversing means comprises motor means for driving said first and second combs about an axis of rotation, sensor means for sensing a stalled condition of said motor means, and means connected to said sensor means for reversing the direction of rotation of said motor means when a stalled condition is sensed.

16. Apparatus as defined in claim 15 wherein said motor means is an electric motor and said sensor means includes means for detecting an increase in the amplitude of the current drawn by said motor.

17. A size-segregation device for sorting and routing particulate material comprising:

an input hopper having a first end and a second end, said first end having an opening for the input of unsegregated particulate material and said second end branching so as to form a first chute and a second chute;

a grid comprising a plurality of parallel bars spaced a first predetermined distance apart, said grid having a sizing-segregating portion angularly positioned at the intersection of said input hopper and said chutes such that particulate material having a size less than said first predetermined distance between said parallel bars shall pass between two adjacent parallel bars of said grid into said first chute and particulate material having a size greater than said first predetermined distance between said parallel bars shall be deflected into said second chute;

a first grid-clearing device comprising a plurality of fingers spaced a second predetermined distance apart and disposed in parallel planes along an axle shaft, said grid-clearing device positioned proximate to said grid so that said axle shaft passes essentially through said parallel bars; and means for continuously rotating said axle shaft of said grid-clearing device such that said fingers project between said parallel bars of said sizing-segregating portion of said grid periodically during the rotation.

18. Apparatus as defined in claim 17 further comprising a second grid clearing device, proximate said grid and acting with said first grid clearing device to clear the grid, comprising a second plurality of fingers spaced said second predetermined distance apart and disposed in parallel planes along a second axle shaft, said second axle shaft of said second grid clearing device positioned parallel and adjacent to the axle shaft of the first grid clearing device and passing essentially through said bars, and means for continuously rotating said second grid clearing device such that said second fingers project between said parallel bars of said grid periodically during the rotation.

19. Apparatus as defined in claim 18 further including means for reversing the direction of rotation of said first and second grid clearing devices, wherein said reversing means comprises motor means for driving said grid clearing devices, sensor means for sensing a stalled condition of said motor means, and means connected to said sensor means for reversing the direction of rotation of said motor means when a stalled condition is sensed.

20. Apparatus as defined in claim 19, wherein said motor means is an electric motor and said sensor means includes means for detecting an increase in the amplitude of the current drawn by said motor.

* * * * *